US009229396B1

(12) United States Patent
Wu et al.

(10) Patent No.: US 9,229,396 B1
(45) Date of Patent: Jan. 5, 2016

(54) FUSER MEMBER

(71) Applicant: Xerox Corporation, Norwalk, CT (US)

(72) Inventors: Jin Wu, Pittsford, NY (US); Matthew M. Kelly, West Henrietta, NY (US); Jonathan H. Herko, Walworth, NY (US); Lin Ma, Pittsford, NY (US); Amy C. Porter, Pittsford, NY (US); Lanhui Zhang, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/558,062

(22) Filed: Dec. 2, 2014

(51) Int. Cl.
*G03G 15/20* (2006.01)

(52) U.S. Cl.
CPC ..... *G03G 15/206* (2013.01)

(58) Field of Classification Search
CPC ..... G03G 15/2057; G03G 15/2053; G03G 15/206; G03G 2215/2035
USPC ..... 399/333
See application file for complete search history.

(56) References Cited

U.S. PATENT DOCUMENTS

| | | | | |
|---|---|---|---|---|
| 2010/0252184 | A1* | 10/2010 | Morimoto et al. | 156/241 |
| 2012/0070609 | A1* | 3/2012 | Poppe et al. | 428/95 |
| 2012/0094081 | A1* | 4/2012 | Kelly et al. | 428/172 |
| 2012/0245251 | A1* | 9/2012 | Moorlag et al. | 523/218 |
| 2013/0122286 | A1* | 5/2013 | Wu | 428/337 |

* cited by examiner

*Primary Examiner* — Walter L Lindsay, Jr.
*Assistant Examiner* — Frederick Wenderoth
(74) *Attorney, Agent, or Firm* — Hoffman Warnick LLC

(57) ABSTRACT

The present teachings provide a fuser member. The fuser member includes a substrate layer that includes a polyimide having dispersed therein a plurality of nanofibrillated cellulose particles. An intermediate layer is disposed on the substrate layer. A release layer is disposed on the intermediate layer.

18 Claims, 4 Drawing Sheets

FUSER MEMBER

BACKGROUND

1. Field of Use

This disclosure is generally directed to fuser members useful in electrophotographic imaging apparatuses, including digital, image on image, and the like. In addition, the fuser member described herein can also be used in a transfix apparatus in a solid ink jet printing machine.

2. Background

Polymers have many desirable properties for engineering systems including low mass density, chemical stability, and high strength-to-mass ratio. Polymeric materials typically have a low thermal conductivity near room temperature; in fact, foams of amorphous polymers are widely used for thermal insulation. In situations where heat transfer is critical, polymeric materials are at a disadvantage. Materials for heat exchangers and thermal management require high thermal conductivity. Metals (Cu, Al, Ti) and certain ceramics (AlN, diamond, graphite) are used for applications requiring high thermal conductivity.

In the electrophotographic printing process, a toner image can be fixed or fused upon a support (e.g., a paper sheet) using a fuser member. Metal and ceramic fillers have been incorporated into polymeric materials to enhance conductivity of fuser members. However, incorporation of metal and ceramic fillers into polymeric material can decrease the Young's modulus of polymeric material. It would be desirable to have a fuser belt having higher thermal conductivity, high thermal diffusivity and a high Young's modulus.

SUMMARY

According to an embodiment, a fuser member is provided. The fuser includes a substrate layer of a polyimide having dispersed therein a plurality of nanofibrillated cellulose particles.

According to another embodiment, a fuser member is provided that includes a substrate layer, an intermediate layer disposed on the substrate layer and a release layer disposed on the intermediate layer. The substrate layer includes polyimide having dispersed therein a plurality of nanofibrillated cellulose particles. The intermediate layer includes a material selected from the group consisting of silicone and fluoroelastomer. The release layer includes a fluoropolymer.

According to another embodiment there is provided a fuser member including a substrate layer having a polyimide having dispersed therein a plurality of nanofibrillated cellulose particles. The nanofibrillated cellulose particles are selected from the group consisting of: cellulose nanofiber particles, microfibrillated cellulose particles, nanocrystalline cellulose particles and bacterial nanocellulose particles. The nanofibrillated cellulose particles have a diameter of from about 5 to about 500 nanometers and a length of from about 100 to about 10,000 nanometers. The fuser member includes an intermediate layer disposed on the substrate layer, the intermediate layer including a material selected from the group consisting of silicone and fluoroelastomer. The fuser member includes a release layer disposed on the intermediate layer. The release layer includes a fluoropolymer.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

Figure 1:
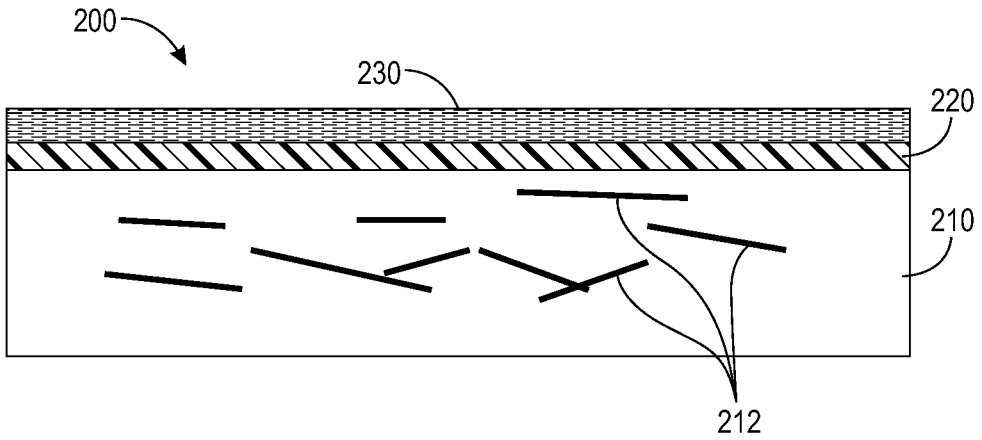
FIG. 1 depicts an exemplary fuser member having a belt substrate in accordance with the present teachings.

It should be noted that some details of the FIGS. have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely illustrative.

Illustrations with respect to one or more implementations, alterations and/or modifications can be made to the illustrated examples without departing from the spirit and scope of the appended claims. In addition, while a particular feature may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

The fuser or fixing member can include a substrate having one or more functional intermediate layers formed thereon. The substrate described herein includes a belt. The one or more intermediate layers include cushioning layers and release layers. Such fuser member can be used as an oil-less fusing member for high speed, high quality electrophotographic printing to ensure and maintain a good toner release from the fused toner image on an image supporting material (e.g., a paper sheet), and further assist paper stripping.

In various embodiments, the fuser member can include, for example, a substrate, with one or more functional intermediate layers formed thereon. The substrate can be formed in various shapes, such as a belt, or a film, using suitable materials that are non-conductive or conductive depending on a specific configuration, for example, as shown in FIG. 1.

In FIG. 1, an exemplary embodiment of a fusing or transfix member 200 can include a belt substrate 210 with one or more functional intermediate layers, e.g., 220 and an outer surface layer 230 formed thereon. The outer surface layer 230 is also referred to as a release layer. The belt substrate 210 is described further and is made of nanofibrillated cellulose particles 212 dispersed in polyimide.

Intermediate Layer or Functional Layer

Examples of materials used for the functional intermediate layer 220 (also referred to as cushioning layer or intermediate layer) include fluorosilicones, silicone rubbers such as room temperature vulcanization (RTV) silicone rubbers, high temperature vulcanization (HTV) silicone rubbers, and low temperature vulcanization (LTV) silicone rubbers. These rubbers are known and readily available commercially, such as SILASTIC® 735 black RTV and SILASTIC® 732 RTV, both from Dow Corning; 106 RTV Silicone Rubber and 90 RTV Silicone Rubber, both from General Electric; and JCR6115CLEAR HTV and SE4705U HTV silicone rubbers from Dow Corning Toray Silicones. Other suitable silicone materials include siloxanes (such as polydimethylsiloxanes); fluorosilicones such as Silicone Rubber 552, available from Sampson Coatings, Richmond, Va.; liquid silicone rubbers such as vinyl crosslinked heat curable rubbers or silanol room temperature crosslinked materials; and the like. Another specific example is Dow Corning Sylgard 182. Commercially available LSR rubbers include Dow Corning Q3-6395, Q3-6396, SILASTIC® 590 LSR, SILASTIC® 591 LSR, SILASTIC® 595 LSR, SILASTIC® 596 LSR, and SILASTIC® 598 LSR from Dow Corning. The functional layers provide elasticity and can be mixed with inorganic particles, for example SiC or $Al_2O_3$, as required.

Other examples of the materials suitable for use as functional intermediate layer 220 also include fluoroelastomers. Fluoroelastomers are from the class of 1) copolymers of two of vinylidenefluoride, hexafluoropropylene, and tetrafluoroethylene; such as those known commercially as VITON A® 2) terpolymers of vinylidenefluoride, hexafluoropropylene, and tetrafluoroethylene those known commercially as VITON B®; and 3) tetrapolymers of vinylidenefluoride, hexafluoropropylene, tetrafluoroethylene, and cure site monomer those known commercially as VITON GH® or VITON GF®. These fluoroelastomers are known commercially under various designations such as those listed above, along with VITON E®, VITON E 60C®, VITON E430®, VITON 910®, and VITON ETP®. The VITON® designation is a Trademark of E.I. DuPont de Nemours, Inc. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer, such as those commercially available from DuPont. Other commercially available fluoropolymers include FLUOREL 2170®, FLUOREL 2174®, FLUOREL 2176®, FLUOREL 2177® and FLUOREL LVS 76®, FLUOREL® being a registered trademark of 3M Company. Additional commercially available materials include AFLAS™ a poly(propylene-tetrafluoroethylene), and FLUOREL II® (LII900) a poly(propylene-tetrafluoroethylenevinylidenefluoride), both also available from 3M Company, as well as the Tecnoflons identified as FOR-60KIR, FOR-LHF®, NM® FOR-THF®, FOR-TFS® TH® NH®, P757® TNS®, T439 PL958® BR9151® and TN505, available from Ausimont.

The fluoroelastomers VITON GH® and VITON GF® have relatively low amounts of vinylidenefluoride. The VITON GF® and VITON GH® have about 35 weight percent of vinylidenefluoride, about 34 weight percent of hexafluoropropylene, and about 29 weight percent of tetrafluoroethylene, with about 2 weight percent cure site monomer.

The thickness of the functional intermediate layer 220 is from about 30 microns to about 1,000 microns, or from about 100 microns to about 800 microns, or from about 150 microns to about 500 microns.

Release Layer

An exemplary embodiment of a release layer 230 includes fluoropolymer particles. Fluoropolymer particles suitable for use in the formulation described herein include fluorine-containing polymers. These polymers include fluoropolymers comprising a monomeric repeat unit that is selected from the group consisting of vinylidene fluoride, hexafluoropropylene, tetrafluoroethylene, perfluoroalkylvinylether, and mixtures thereof. The fluoropolymers may include linear or branched polymers, and cross-linked fluoroelastomers. Examples of fluoropolymer include polytetrafluoroethylene (PTFE); perfluoroalkoxy polymer resin (PFA); copolymer of tetrafluoroethylene (TFE) and hexafluoropropylene (HFP); copolymers of hexafluoropropylene (HFP) and vinylidene fluoride (VDF or VF2); terpolymers of tetrafluoroethylene (TFE), vinylidene fluoride (VDF), and hexafluoropropylene (HFP); and tetrapolymers of tetrafluoroethylene (TFE), vinylidene fluoride (VF2), and hexafluoropropylene (HFP), and mixtures thereof. The fluoropolymer particles provide chemical and thermal stability and have a low surface energy. The fluoropolymer particles have a melting temperature of from about 255° C. to about 360° C. or from about 280° C. to about 330° C. These particles are melted to form the release layer.

For the fuser member 200, the thickness of the outer surface layer or release layer 230 can be from about 10 microns to about 100 microns, or from about 20 microns to about 80 microns, or from about 40 microns to about 60 microns.

Adhesive Layer(s)

Optionally, any known and available suitable adhesive layer, also referred to as a primer layer, may be positioned between the release layer 230, the functional intermediate layer 220 and the substrate 210. Examples of suitable adhesives include silanes such as amino silanes (such as, for example, HV Primer 10 from Dow Corning), titanates, zirconates, aluminates, and the like, and mixtures thereof. In an embodiment, an adhesive in from about 0.001 percent to about 10 percent solution can be wiped on the substrate. The adhesive layer can be coated on the substrate, or on the outer layer, to a thickness of from about 2 nanometers to about 2,000 nanometers, or from about 2 nanometers to about 500 nanometers. The adhesive can be coated by any suitable known technique, including spray coating or wiping.

Figure 2:
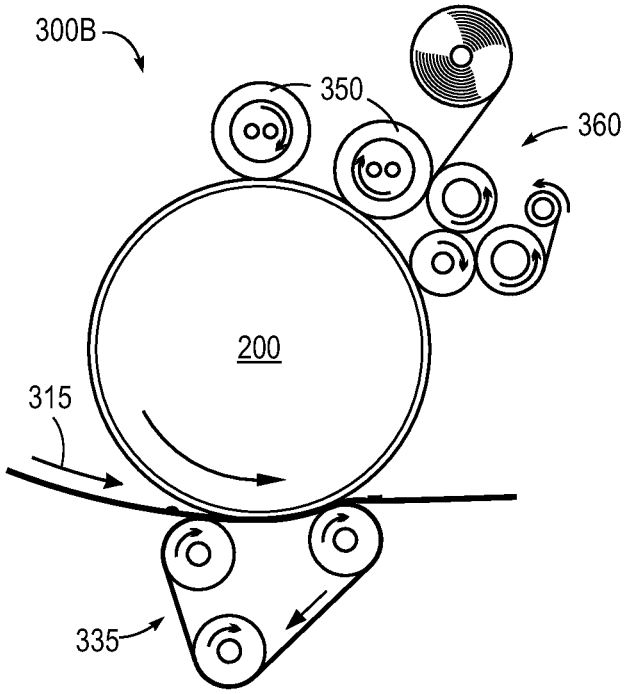
FIG. 2 depicts an exemplary fusing configuration using the fuser member shown in FIG. 1 in accordance with the present teachings.
Figure 3:
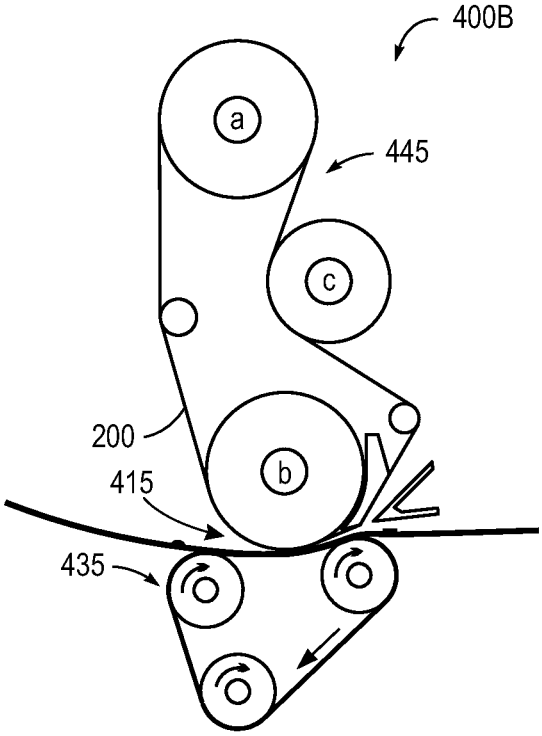
FIG. 3 depicts an exemplary fusing configuration using the fuser member shown in FIG. 1 in accordance with the present teachings.

FIGS. 2 and 3 depict an exemplary fusing configuration for the fusing process in accordance with the present teachings. It should be readily apparent to one of ordinary skill in the art that the fusing configurations 300B and 400B depicted in FIGS. 2 and 3, respectively, represent generalized schematic illustrations and that other members/layers/substrates/configurations can be added or existing members/layers/substrates/configurations can be removed or modified. Although an electrophotographic printer is described herein, the disclosed apparatus and method can be applied to other printing technologies. Examples include offset printing and inkjet and solid transfix machines.

FIG. 2 depicts the fusing configuration 300B using a fuser belt shown in FIG. 1 in accordance with the present teachings. The configuration 300B can include a fuser belt of FIG. 1 that forms a fuser nip with a pressure applying mechanism 335, such as a pressure belt, for an image supporting material 315. In various embodiments, the pressure applying mechanism 335 can be used in combination with a heat lamp (not shown) to provide both the pressure and heat for the fusing process of the toner particles on the image supporting material 315. In addition, the configuration 300B can include one or more external heat rolls 350 along with, e.g., a cleaning web 360, as shown in FIG. 2.

FIG. 3 depicts the fusing configuration 400B using a fuser belt shown in FIG. 1 in accordance with the present teachings. The configuration 400B can include a fuser belt (i.e., 200 of FIG. 1) that forms a fuser nip with a pressure applying mechanism 435, such as a pressure belt in FIG. 3, for a media substrate 415. In various embodiments, the pressure applying mechanism 435 can be used in a combination with a heat lamp to provide both the pressure and heat for the fusing process of the toner particles on the media substrate 415. In addition, the configuration 400B can include a mechanical system 445 to move the fuser belt 200 and thus fusing the toner particles and forming images on the media substrate 415. The mechanical system 445 can include one or more rolls 445*a-c*, which can also be used as heat rolls when needed.

Figure 4:
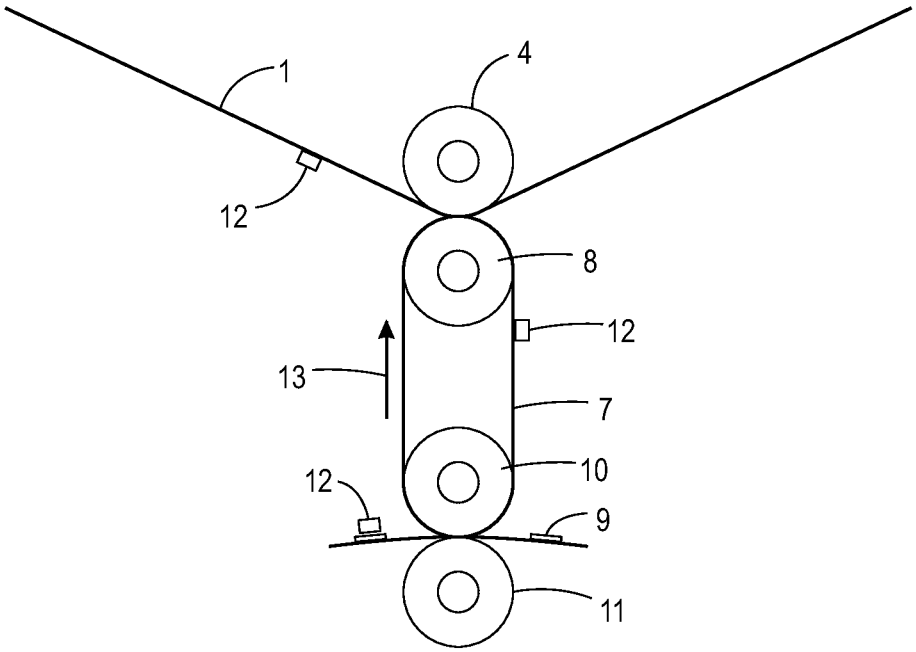
FIG. 4 depicts a fuser configuration using a transfix apparatus.

FIG. 4 demonstrates a view of an embodiment of a transfix member 7 which may be in the form of a belt, sheet, film, or like form. The transfix member 7 is constructed similarly to the fuser belt described above. The developed image 12 positioned on intermediate transfer member 1, is brought into contact with and transferred to transfix member 7 via rollers 4 and 8. Roller 4 and/or roller 8 may or may not have heat associated therewith. Transfix member 7 proceeds in the direction of arrow 13. The developed image is transferred and fused to a copy substrate 9 as copy substrate 9 is advanced between rollers 10 and 11. Rollers 10 and/or 11 may or may not have heat associated therewith.

Substrate Layer

The substrate layer 210 disclosed herein is a composition of polyimide having nanofibrillated cellulose particles 212 dispersed throughout the polyimide. The incorporation of nanofibrillated cellulose particles 212 into the polyimide provides a higher thermal diffusivity, a higher thermal conductivity and a higher Young's modulus than a fuser belt without the fiber. The nanofibrillated cellulose particles 212 shown in FIG. 1 are not to scale and shown for illustration.

The nanofibrillated cellulose particles include cellulose nanofiber, microfibrillated cellulose, nanocrystalline cellulose, bacterial nanocellulose, and the like.

Microfibrillated cellulose is typically produced by the high pressure homogenization of pulps. Pulp is produced from wood by chemical treatment using sodium hydroxide (kraft pulp), sodium sulfide (sulfite pulp). The pulp is delaminated often assisted by the addition of hydrophilic polymers, charged groups or enzyme treatment to produce the microfibrillated cellulose particles. Nanocrystalline cellulose are cellulose nanocrystals prepared from natural cellulose by acid hydrolysis. Bacterial nanocellulose is formed from bacterial biosynthesis of low-molecular weight sugars.

The nanofibrillated cellulose particles described herein possess a diameter of from about 5 to about 500 nanometers, or in embodiments from about 10 to about 300 nanometers, or in embodiments from about 15 to about 250 nanometers. The nanofibrillated cellulose particles described herein possess have a length of from about 100 to about 10,000 nanometers, or in embodiments of from about 200 to about 2,000 nanometers, or in embodiments of from about 2500 to about 1,800 nanometers. The nanofibrillated cellulose particles are from about 0.1 weight percent to about 40 weight percent of the substrate layer, or in embodiments from about 0.2 weight percent to about 30 weight percent of the substrate layer, 0.5 weight percent to about 25 weight percent of the substrate layer.

The nanofibrillated cellulose particles 212 are commercially available from CelluComp with the trade name of Curran® fibers.

The nanofibrillated cellulose particles (Curran® fibers) are produced by CelluComp using a proprietary process. They are manufactured from waste streams produced by the food processing industry. Common raw materials are carrots or sugar beet and, because only materials otherwise discarded by the food industry are used, it does not compete with food crops for scarce land. Curran® fibers are strong, stiff and light, which properties allow the production of composites with performance characteristics comparable to those based on conventional carbon fiber technology.

The nanofibrillated cellulose particles 212 possess a high tensile strength. The nanofibrillated cellulose particles 212 are excellent for impact energy absorption.

The polyimide is derived from corresponding polyamic acid such as one of a polyamic acid of pyromellitic dianhydride/4,4'-oxydianiline, a polyamic acid of pyromellitic dianhydride/phenylenediamine, a polyamic acid of biphenyl tetracarboxylic dianhydride/4,4'-oxydianiline, a polyamic acid of biphenyl tetracarboxylic dianhydride/phenylenediamine, a polyamic acid of benzophenone tetracarboxylic dianhydride/4,4'-oxydianiline, a polyamic acid of benzophenone tetracarboxylic dianhydride/4,4'-oxydianiline/phenylenediamine, and the like and mixtures thereof.

Commercial examples of polyamic acid of pyromellitic dianhydride/4,4-oxydianiline include PYRE-ML RC5019 (about 15-16 weight percent in N-methyl-2-pyrrolidone, (NMP)), RC5057 (about 14.5-15.5 weight percent in NMP/aromatic hydrocarbon=80/20), and RC5083 (about 18-19 weight percent in NMP/DMAc=15/85), all from Industrial Summit technology Corp., Parlin, N.J.; and DURIMIDE® 100, commercially available from FUJIFILM Electronic Materials U.S.A., Inc.

Commercial examples of polyamic acid of biphenyl tetracarboxylic dianhydride/4,4'-oxydianiline include U-VARNISH A, and S (about 20 weight in NMP), both from UBE America Inc., New York, N.Y.

Commercial examples of polyamic acid of biphenyl tetracarboxylic dianhydride/phenylenediamine include PI-2610 (about 10.5 weight in NMP), and PI-2611 (about 13.5 weight in NMP), both from HD MicroSystems, Parlin, N.J.

Commercial examples of polyamic acid of benzophenone tetracarboxylic dianhydride/4,4'-oxydianiline include RP46, and RP50 (about 18 weight percent in NMP), both from Unitech Corp., Hampton, Va.

Commercial examples of polyamic acid of benzophenone tetracarboxylic dianhydride/4,4'-oxydianiline/phenylenediamine include P1-2525 (about 25 weight percent in NMP), P1-2574 (about 25 weight percent in NMP), P1-2555 (about 19 weight percent in NMP/aromatic hydrocarbon=80/20), and P1-2556 (about 15 weight percent in NMP/aromatic hydrocarbon/propylene glycol methyl ether=70/15/15), all from HD MicroSystems, Parlin, N.J.

Various amounts of polyamic acid can be selected for the substrate, such as for example, from about 60 weight percent to about 99.9 weight percent, from about 70 weight percent to about 99.5 weight percent, or from about 75 weight percent to about 99.0 weight percent.

Other polyamic acid or ester of polyamic acid examples that can be included in the polyimide substrate layer are from the reaction of a dianhydride and a diamine. Suitable dianhydrides include aromatic dianhydrides and aromatic tetracarboxylic acid dianhydrides such as, for example, 9,9-bis(trifluoromethyl)xanthene-2,3,6,7-tetracarboxylic acid dianhydride, 2,2-bis(3,4-dicarboxyphenyl)hexafluoropropane dianhydride, 2,2-bis((3,4-dicarboxyphenoxy)phenyl) hexafluoropropane dianhydride, 4,4'-bis(3,4-dicarboxy-2,5,6-trifluorophenoxy)octafluorobiphenyl dianhydride, 3,3',4,4'-tetracarboxybiphenyl dianhydride, 3,3',4,4'-tetracarboxybenzophenone dianhydride, di-(4-(3,4-dicarboxyphenoxyl)phenyl)ether dianhydride, di-(4-(3,4-dicarboxyphenoxyl)phenyl) sulfide dianhydride, di-(3,4-dicarboxyphenyl)methane dianhydride, di-(3,4-dicarboxyphenyl)ether dianhydride, 1,2,4,5-tetracarboxybenzene dianhydride, 1,2,4-tricarboxybenzene dianhydride, butanetetracarboxylic dianhydride, cyclopentanetetracarboxylic dianhydride, pyromellitic dianhydride, 1,2,3,4-benzenetetracarboxylic dianhydride, 2,3,6,7-naphthalenetetracarboxylic dianhydride, 1,4,5,8-naphthalenetetracarboxylic dianhydride, 1,2,5,6-naphthalenetetracarboxylic dianhydride, 3,4,9,10-perylenetetracarboxylic dianhydride, 2,3,6,7-anthracene tetracarboxylic dianhydride, 1,2,7,8-phenanthrenetetracarboxylic dianhydride, 3,3',4,4'-biphenyltetracarboxylic dianhydride, 2,2',3,3'-biphenyltetracarboxylic dianhydride, 3,3',4-4'-benzophenonetetracarboxylic dianhydride, 2,2',3,3'-benzophenonetetracarboxylic dianhydride, 2,2-bis(3,4-dicarboxyphenyl)propane dianhydride, 2,2-bis(2,3-dicarboxyphenyl)propane dianhydride, bis(3,4-dicarboxyphenyl)ether dianhydride, bis(2,3-dicarboxyphenyl)ether dianhydride, bis(3,4-dicarboxyphenyl)sulfone dianhydride, bis(2,3-dicarboxyphenyl)sulfone 2,2-bis(3,4-dicarboxyphenyl)-1,1,1,3,3,3-hexafluoropropane dianhydride, 2,2-bis(3,4-dicarboxyphenyl)-1,1,1,3,3,3-hexachloropropane dianhydride, 1,1-bis(2,3-dicarboxyphenyl)ethane dianhydride, 1,1-bis(3,4-dicarboxyphenyl)ethane dianhydride, bis(2,3-dicarboxyphenyl)methane dianhydride, bis(3,4-dicarboxyphenyl)methane dianhydride, 4,4'-(p-phenylenedioxy)diphthalic dianhydride, 4,4'-(m-phenylenedioxy) diphthalic dianhydride, 4,4'-diphenylsulfidedioxybis(4-phthalic acid)dianhydride, 4,4'-diphenylsulfonedioxybis(4-phthalic acid)dianhydride, methylenebis(4-phenyleneoxy-4-phthalic acid)dianhydride, ethylidenebis(4-phenyleneoxy-4-phthalic acid)dianhydride, isopropylidenebis-(4-phenyleneoxy-4-phthalic acid)dianhydride, hexafluoroisopropylidenebis(4-phenyleneoxy-4-phthalic acid)dianhydride, and the like. Exemplary diamines suitable for use in the preparation of the polyamic acid include 4,4'-bis-(m-aminophenoxy)-biphenyl, 4,4'-bis-(m-aminophenoxy)-diphenyl sulfide, 4,4'-bis-(m-aminophenoxy)-diphenyl sulfone, 4,4'-bis-(p-aminophenoxy)-benzophenone, 4,4'-bis-(p-aminophenoxy)-diphenyl sulfide, 4,4'-bis-(p-aminophenoxy)-diphenyl sulfone, 4,4'-diamino-azobenzene, 4,4'-diaminobiphenyl, 4,4'-diaminodiphenylsulfone, 4,4'-diamino-p-terphenyl, 1,3-bis-(gamma-aminopropyl)-tetramethyl-disiloxane, 1,6-diaminohexane, 4,4'-diaminodiphenylmethane, 3,3'-diaminodiphenylmethane, 1,3-diaminobenzene, 4,4'-diaminodiphenyl ether, 2,4'-diaminodiphenylether, 3,3'-diaminodiphenylether, 3,4'-diaminodiphenylether, 1,4-diaminobenzene, 4,4'-diamino-2,2',3,3',5,5',6,6'-octafluoro-biphenyl, 4,4'-diamino-2,2',3,3',5,5',6,6'-octafluorodiphenyl ether, bis[4-(3-aminophenoxy)-phenyl]sulfide, bis[4-(3-aminophenoxyl)phenyl]sulfone, bis[4-(3-aminophenoxyl)phenyl]ketone, 4,4'-bis(3-aminophenoxy)biphenyl, 2,2-bis[4-(3-aminophenoxyl)phenyl]-propane, 2,2-bis[4-(3-aminophenoxyl)phenyl]-1,1,1,3,3,3-hexafluoropropane, 4,4'-diaminodiphenyl sulfide, 4,4'-diaminodiphenyl ether, 4,4'-diaminodiphenyl sulfone, 4,4'-diaminodiphenylmethane, 1,1-di(p-aminophenyl) ethane, 2,2-di(p-aminophenyl)propane, and 2,2-di(p-aminophenyl)-1,1,1,3,3,3-hexafluoropropane, and the like and mixtures thereof.

The dianhydrides and diamines are, for example, selected in a weight ratio of dianhydride to diamine of from about 20:80 to about 80:20, and more specifically, in an about 50:50 weight ratio. The above aromatic dianhydride like aromatic tetracarboxylic acid dianhydrides and diamines like aromatic diamines are used singly or as a mixture, respectively.

The nanofibrillated cellulose particles/polyimide substrate can optionally contain a polysiloxane copolymer to enhance or smooth the coating. The concentration of the polysiloxane copolymer is from about 0.01 weight percent to about 1.0 weight percent based on the total weight of the substrate. The optional polysiloxane copolymer includes a polyester modified polydimethylsiloxane, commercially available from BYK Chemical with the trade name of BYK® 310 (about 25 weight percent in xylene) and 370 (about 25 weight percent in xylene/alkylbenzenes/cyclohexanone/monophenylglycol=75/11/7/7); a polyether modified polydimethylsiloxane, commercially available from BYK Chemical with the trade name of BYK® 330 (about 51 weight percent in methoxypropylacetate) and 344 (about 52.3 weight percent in xylene/isobutanol=80/20), BYK®-SILCLEAN 3710 and 3720 (about 25 weight percent in methoxypropanol); a polyacrylate modified polydimethylsiloxane, commercially available from BYK Chemical with the trade name of BYK®-SILCLEAN 3700 (about 25 weight percent in methoxypropylacetate); or a polyester polyether modified polydimethylsiloxane, commercially available from BYK Chemical with the trade name of BYK® 375 (about 25 weight percent in Dipropylene glycol monomethyl ether).

Additives and additional conductive or non-conductive fillers may be present in the above-described substrate layer, intermediate layer or release layer. In various embodiments, other filler materials or additives including, for example, inorganic particles, can be used. Fillers used herein include carbon blacks, aluminum nitride, boron nitride, aluminum oxide, graphite, graphene, copper flake, nano diamond, carbon nanotube, metal oxide, doped metal oxide, metal flake, and mixtures thereof. In various embodiments, other additives known to one of ordinary skill in the art can also be included to form the disclosed composite materials.

The nanofibrillated cellulose particles/polyimide composition is flow coated onto a substrate and cured. The curing of the nanofibrillated cellulose particles/polyimide composition is at a temperature of from about 200° C. to about 370° C., or from about 300° C. to about 340° C., for a time of from about 30 minutes to about 150 minutes, or from about 60 minutes to about 120 minutes. The curing can be done in stages with the composition under tension in the final stage.

Examples

Experimentally, a polyamic acid of biphenyl tetracarboxylic dianhydride/p-benzenedianiline (BPDA resin from Kaneka, about 16.6 weight percent in NMP) was mixed with the nanofibrillated cellulose particles (Curran® THIXCV5000) and additional NMP solvent with a high shear mixer at the weight ratio of 95/5. After coating and subsequent curing at 170° C. for 30 minutes and 320° C. for 120 minutes, a nanofibrillated cellulose particles/polyimide composite belt was obtained for fuser belt application. The resulting polyimide composite belt was tested and possessed a significantly higher thermal diffusivity and thermal conductivity than the control polyimide belt by using the LFA 447 Nanoflash instrument. The higher thermal diffusivity and thermal conductivity is shown in Table 1.

TABLE 1

| | polyimide | polyimide/5 wt % of nanofibrillated cellulose |
|---|---|---|
| thermal diffusivity ($mm^2/s$) at 25° C. | 0.1985 | 0.3525 |
| thermal diffusivity ($mm^2/s$) at 200° C. | 0.1445 | 0.2235 |
| thermal conductivity [W/(m° K)] at 25° C. | 0.2963 | 0.7112 |
| thermal conductivity [W/(m° K)] at 200° C. | 0.3498 | 0.8174 |

Besides thermal conductivity, other properties of the disclosed fuser belt were also tested, and the data are shown in Table 2.

TABLE 2

| | Young's modulus (MPa) | Onset decomposition T (° C.) |
|---|---|---|
| polyimide | 6,000 | 510 |
| polyimide/5 wt % of nanofibrillated cellulose | 8,260 | 620 |

The disclosed polyimide/nanofibrillated cellulose particles fuser showed higher Young's modulus and onset decomposition temperature when compared to the controlled polyimide fuser.

In summary, disclosed herein is a polyimide fuser belt where nanofibrillated cellulose particles are incorporated for higher thermal diffusivity, thermal conductivity and modulus.

It will be appreciated that variants of the above-disclosed and other features and functions or alternatives thereof may be combined into other different systems or applications. Various presently unforeseen or unanticipated alternatives, modifications, variations, or improvements therein may be subsequently made by those skilled in the art, which are also encompassed by the following claims.

What is claimed is:

1. A fuser member comprising:

a substrate layer comprising a polyimide having dispersed therein a plurality of nanofibrillated cellulose particles, wherein the nanofibrillated cellulose particles comprise from about 0.1 weight percent to about 40 weight percent of the substrate layer.

2. The fuser member of claim 1, wherein the nanofibrillated cellulose particles are selected from the group consisting of: cellulose nanofiber particles, microfibrillated cellulose particles, nanocrystalline cellulose particles and bacterial nanocellulose particles.

3. The fuser member of claim 1, wherein the nanofibrillated cellulose particles have a diameter of from about 5 nanometers to about 500 nanometers.

4. The fuser member of claim 1, wherein the nanofibrillated cellulose particles have a length of from about 100 nanometers to about 10,000 nanometers.

5. The fuser member of claim 1, further comprising:

an intermediate layer disposed on the substrate layer; and a release layer disposed on the intermediate layer.

6. The fuser member of claim 5, wherein the intermediate layer comprises silicone.

7. The fuser member of claim 5, wherein the release layer comprises a fluoropolymer.

8. The fuser member of claim 1, wherein the substrate layer further comprises a polysiloxane polymer.

9. The fuser member of claim 8, wherein the polysiloxane polymer is selected from the group consisting of: a polyester modified polydimethylsiloxane, a polyether modified polydimethylsiloxane, a polyacrylate modified polydimethylsiloxane, and a polyester polyether modified polydimethylsiloxane.

10. The fuser member of claim 8, wherein the polysiloxane polymer comprises from about 0.01 weight percent to about 1.0 weight percent of the substrate layer.

11. The fuser member of claim 1, wherein the substrate layer further comprises at least one filler.

12. The fuser member of claim 11, wherein the at least one filler is selected from the group consisting of aluminum nitride, boron nitride, aluminum oxide, graphite, graphene, copper flake, nano diamond, carbon black, carbon nanotube, metal oxides, doped metal oxide, metal flake and mixtures thereof.

13. A fuser member comprising:

a substrate layer comprising a polyimide having dispersed therein a plurality of nanofibrillated cellulose particles, wherein the nanofibrillated cellulose particles have a diameter of from about 5 nanometers to about 500 nanometers;

an intermediate layer disposed on the substrate layer comprising a material selected from the group consisting of: silicone and fluoroelastomer; and a release layer disposed on the intermediate layer, the release layer comprising a fluoropolymer.

14. The fuser member of claim 13, wherein the nanofibrillated cellulose particles have a length of from about 100 nanometers to about 10,000 nanometers.

15. The fuser member of claim 13, wherein the release layer further comprises at least one filler.

16. The fuser member of claim 15, wherein the at least one filler is selected from the group consisting of: aluminum nitride, boron nitride, aluminum oxide, graphite, graphene, copper flake, nano diamond, carbon black, carbon nanotube, metal oxides, doped metal oxide, metal flake, and mixtures thereof; and wherein the fluoropolymer comprises a fluoroelastomer or a fluoroplastic.

17. A fuser member comprising:

a substrate layer having a polyimide having dispersed therein a plurality of nanofibrillated cellulose particles selected from the group consisting of: cellulose nanofiber particles, microfibrillated cellulose particles, nanocrystalline cellulose particles and bacterial nanocellulose particles, wherein the nanofibrillated cellulose particles have a diameter of from about 5 nanometers to about 500 nanometers and a length of from about 100 nanometers to about 10,000 nanometers;

an intermediate layer disposed on the substrate layer, the intermediate layer comprising a material selected from the group consisting of silicone and fluoroelastomer; and a release layer disposed on the intermediate layer, the release layer comprising a fluoropolymer.

18. The fuser member of claim 17, wherein the plurality nanofibrillated cellulose particles comprise from about 0.1 weight percent to about 40 weight percent of the substrate layer.

* * * * *